US010807784B2

(12) United States Patent
Scholvin

(10) Patent No.: US 10,807,784 B2
(45) Date of Patent: Oct. 20, 2020

(54) METHOD FOR MANUFACTURING PROTECTIVE PACKAGING STRUCTURE

(71) Applicant: William Scholvin, Livermore, CA (US)

(72) Inventor: William Scholvin, Livermore, CA (US)

( * ) Notice: Subject to any disclaimer, the term of this patent is extended or adjusted under 35 U.S.C. 154(b) by 254 days.

(21) Appl. No.: 16/123,245

(22) Filed: Sep. 6, 2018

(65) Prior Publication Data

US 2019/0023472 A1 Jan. 24, 2019

Related U.S. Application Data

(62) Division of application No. 15/659,789, filed on Jul. 26, 2017, now Pat. No. 10,099,835.

(Continued)

(51) Int. Cl.

| | |
|---|---|
| ***B65D 81/05*** | (2006.01) |
| ***B31B 50/14*** | (2017.01) |
| ***B31B 50/20*** | (2017.01) |
| ***B65D 5/02*** | (2006.01) |
| ***B65D 5/32*** | (2006.01) |

(Continued)

(52) U.S. Cl.

CPC ..... *B65D 81/05* (2013.01); *B31B 50/142* (2017.08); *B31B 50/20* (2017.08); *B65D 5/0281* (2013.01); *B65D 5/328* (2013.01); *B65D 5/4266* (2013.01); *B65D 5/5066* (2013.01)

(58) Field of Classification Search

None

See application file for complete search history.

(56) References Cited

U.S. PATENT DOCUMENTS

| | | | |
|---|---|---|---|
| 1,842,034 | A | 1/1932 | Lewis |
| 2,256,995 | A | 9/1941 | Andres |

(Continued)

FOREIGN PATENT DOCUMENTS

| | | | |
|---|---|---|---|
| FR | 2404576 | | 4/1979 |
| FR | 2853629 | A1 | 10/2004 |

(Continued)

*Primary Examiner* — Hemant Desai
*Assistant Examiner* — Tanzim Imam
(74) *Attorney, Agent, or Firm* — Laubscher & Laubshcher, P.C.

(57) ABSTRACT

A packaging structure for at least one article includes a pair of generally rectangular support structures with front, side, rear, and interior walls. The walls divide the rectangular support structure into a plurality of triangular sections. The front and interior walls contain a least one opening configured to correspond with the configuration of the article to hold and secure the article in place. The packaging structure is created from a rectangular blank made of foldable material that has a plurality of spaced vertical fold lines, panels, and aligned openings each configured to correspond with the configuration of the article. The packaging structure is formed by folding the blank along the fold lines and securing the blank in the folded condition. The blanks are formed first within computer aided design software by determining the dimensions and profile of a packaging structure, forming openings for an article in a packaging structure, unfolding the packaging structure within the design software into a flat pattern to form a master blank, and using the master blank to create cutting dies for forming additional blanks.

4 Claims, 12 Drawing Sheets

Related U.S. Application Data

(60) Provisional application No. 62/367,095, filed on Jul. 26, 2016.

(51) Int. Cl.
*B65D 5/42* (2006.01)
*B65D 5/50* (2006.01)

(56) References Cited

U.S. PATENT DOCUMENTS

| | | | | |
|---|---|---|---|---|
| 2,653,708 | A | 9/1953 | Spalding | |
| 2,828,902 | A | 4/1958 | Ringler | |
| 3,059,830 | A | 10/1962 | Kramer | |
| 3,086,689 | A | 4/1963 | Wiednmeier | |
| 3,211,282 | A | 10/1965 | Hennessey | |
| 3,587,838 | A | 6/1971 | Miyata | |
| 3,752,301 | A | 8/1973 | Bluemel | |
| 5,005,705 | A | 4/1991 | Combs | |
| 5,090,571 | A * | 2/1992 | Walker | A61F 2/0095 206/438 |
| 5,121,838 | A | 6/1992 | Dickle | |
| 5,322,210 | A | 6/1994 | Chila | |
| 6,712,212 | B2 | 3/2004 | Auclair | |
| 6,997,323 | B2 | 2/2006 | Maresh et al. | |
| 7,731,033 | B2 * | 6/2010 | Sattora | B65D 5/5035 206/592 |
| 8,079,472 | B2 | 12/2011 | Gillain | |
| 2003/0019779 | A1 * | 1/2003 | Horbal | B65D 81/05 206/521 |
| 2009/0173659 | A1 | 7/2009 | Li | |
| 2012/0085817 | A1 | 4/2012 | Gatrost | |

FOREIGN PATENT DOCUMENTS

| | | |
|---|---|---|
| GB | 916967 | 1/1963 |
| JP | H01182237 A | 7/1989 |
| JP | H10258879 A | 9/1998 |

* cited by examiner

METHOD FOR MANUFACTURING PROTECTIVE PACKAGING STRUCTURE

This application is a division of U.S. patent application Ser. No. 15/659,789 filed Jul. 26, 2017 which claims the benefit of U.S. provisional application No. 62/367,095 filed Jul. 26, 2016. The entire contents of these applications are incorporated herein by reference.

BACKGROUND OF THE INVENTION

The present disclosure relates to a protective packaging structure formed from a foldable material such as cardboard, fiberboard, or corrugated plastic, for one or more articles and to a method for making protective packaging structures.

In the field of commercial shipments and logistics, the strength of packaging and its ability to provide safety and protection to the packaged product is critical for a great variety of consumer goods. Unfortunately, it is a common occurrence for shipping packages and parcels to take abuse during transit, resulting in damage of the merchandise they carry. Such shipment damage involves additional costs and operations, such as return of the damaged product to the seller or manufacturer, discard of the damaged product, re-shipping of the replacement product, issuing refunds and/or processing insurance claims.

A primary goal of packaging is to minimize the risk of such occurrences by protecting the packaged article from falls, impacts and crushing weight during storage, handling and transportation. At the same time, for manufacturing costs and environmental considerations, the packaging needs to be formed from as little material as possible and cause as little material waste during production as possible. Another consideration is discarding the packaging upon delivery of the product, which is becoming an environmental issue of growing importance worldwide. It is greatly desirable for as many packaging components as possible to be 100% recyclable.

The prior art includes various types of packaging materials and designs. Examples of best packaging practices known so far include inner packs and dividers, bubble wrap, wrapping all articles at high or moderate risk individually, packing peanuts, inflated air bags, molded pulp inserts, expanded foam and combinations thereof. However, conventional packaging is only marginally effective, or expensive to manufacture, or not environmentally friendly.

Accordingly, there exists a need for packaging that provides better protection to the product inside, requires minimum manufacturing material and cost with minimum material waste. Additionally, there is a need for packaging made from material that is 100% recyclable and/or reusable.

Prior methods for developing and making protective packaging include an often onerous and imprecise process. They involve projecting the two dimensional profile of an article on a flat piece of cardboard to be cut out to create a flat master blank. This process requires numerous calculations or a significant amount of trial and error to place the cuts in their correct location. This results in wasted time and material.

SUMMARY OF THE INVENTION

Accordingly, it is an object of the present disclosure to provide a packaging structure for at least one article. A preferred embodiment includes a pair of generally rectangular support structure. Each support structure includes a front wall, a pair of side walls connected with the front wall, a rear wall connected with the side walls and interior walls connected with opposite edges of the side and rear walls. The walls divide the rectangular support structure into a plurality of triangular sections. In addition, the front and interior walls contain at least one opening that defines at least one compartment configured to correspond with the configuration of the article. An article is placed within the compartments of one support structure. The other support structure front wall is aligned with the front wall of the first support structure in contiguous relation so that the article is retained within the support structures.

It is another object of the present disclosure to provide a blank for forming a packaging structure for at least one article. A preferred embodiment includes a rectangular piece of foldable material such as cardboard, fiberboard, or corrugated plastic. The blank contains a plurality of spaced vertical fold lines which define a sequence of rectangular panels, and a plurality of aligned openings each configured to correspond with the configuration of an article. The blank further includes a central panel which contains at least one opening and a pair of fold lines at each side, and a pair of elongated portions extending outwardly from each side of the central panel. The elongated portions include a plurality of fold lines, a plurality of panels, and at least one opening bridging a fold line extending into adjacent panels. A rectangular packaging structure is formed by folding the end panels of the elongated portions inwardly toward the central panel and then performing a series of folds along the fold lines of the elongated portions. The resulting rectangular packaging structure includes side, front, interior and rear walls that define triangular sections. The openings that bridge the fold lines are arranged in the packaging structure interior walls, and the central panel opening is in the front wall. The openings are aligned to form a compartment and receive at least one article.

In another embodiment, for structural integrity of the support structure, the fold lines on opposite sides of the central panel contain at least one opening and the outer ends of the elongated portions contain at least one projection. The projection interlocks within the opening to retain the packaging structure in a folded condition.

In yet another embodiment, for structural integrity of the packaging structure, an adhesive tape is applied as needed across the packaging structure to lock the support structures into place.

It is yet another aspect of the present disclosure to provide a method for forming a blank for forming a packaging structure for at least one article, preferably, by means of computer aided design (CAD) software. The blank can be made in the CAD program and formed by completing the following steps: determining the dimensions and profile of a packaging structure in accordance with the dimensions and profile of the article and the desired distance between the article and an inner surface of an outer shipping container or box; creating a packaging structure of the dimensions within the software; forming openings in the material that correspond in configuration with the shape of the article; and unfolding the packaging structure within the design software into a flat pattern that will illustrate the exact location of the folds and cut lines; importing the flat pattern into the industry standard software to be used as a master blank to create cutting dies for manufacturing additional blanks corresponding to the master blank.

If the packaging structure is for an article that has rotational symmetry, only one set of cutting dies for the support structure needs to be made since both support structures are identical. The openings for such an article are defined by completing the following steps: in a computer aided design (CAD) program, creating a support structure of the required dimensions and profiles and one half of the article's profile as determined by the article's rotational axis of symmetry; placing an axis of rotation at the center of the support structure on a front central wall; placing the article's half profile onto the front central wall of the support structure with the article's rotational axis of symmetry coincident with the axis of rotation and having the software program execute a Revolve Cut of the article's half profile 180 degrees about the axis of rotation through the support structure creating a compartment in the support structure in the shape of half of the article and defining the shape and location of the cut edges of the openings in the front and interior walls of the support structure.

If the packaging structure is for an asymmetrical article, the opening defining steps include: in a computer aided design (CAD) software, creating a packaging structure of the required dimensions and profiles and a three-dimensional image of the article; placing the article inside the packaging structure so that the orientation of the article is optimal for said article and so that at least a minimum distance is maintained from all six sides of the outer shipping container or box that will contain the packaging structure and the article; and using a Boolean Subtract command of the software to create an opening or compartment in the packaging structure corresponding to the shape of the article which defines the shape and location of the cut edges of the openings in the front and interior walls of the packaging structure.

In the preferred embodiments, the packaging structure is placed within an outer shipping container or box with a snug fit designed to contain the packaging structure securely.

BRIEF DESCRIPTION OF THE FIGURES

Other objects and advantages of the disclosure will become apparent from a study of the following specification when viewed in the light of the accompanying drawing, in which.

DETAILED DESCRIPTION

Figure 1:
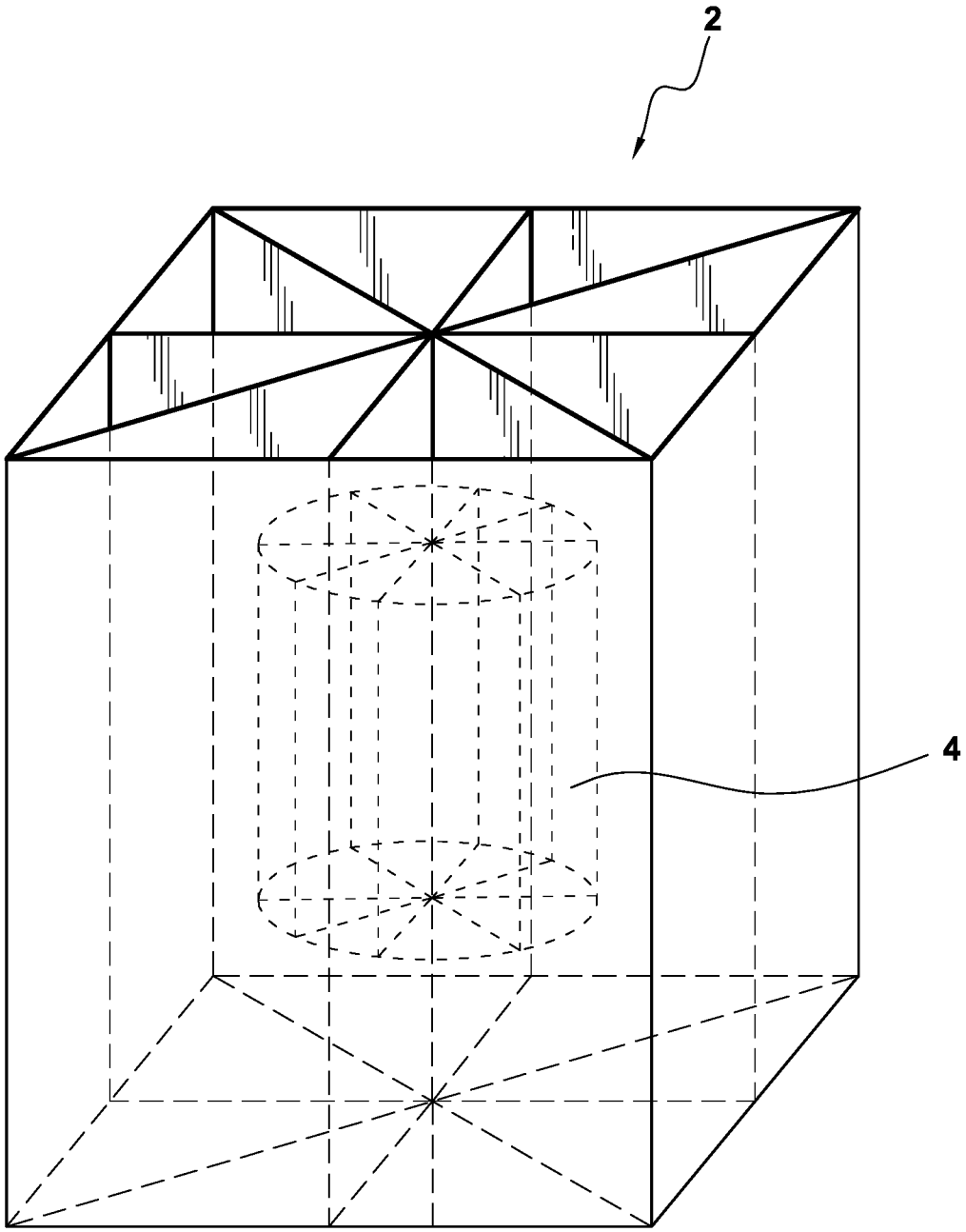
FIG. 1 is a perspective view of one embodiment of the packaging structure with an article therein.
Figure 2:
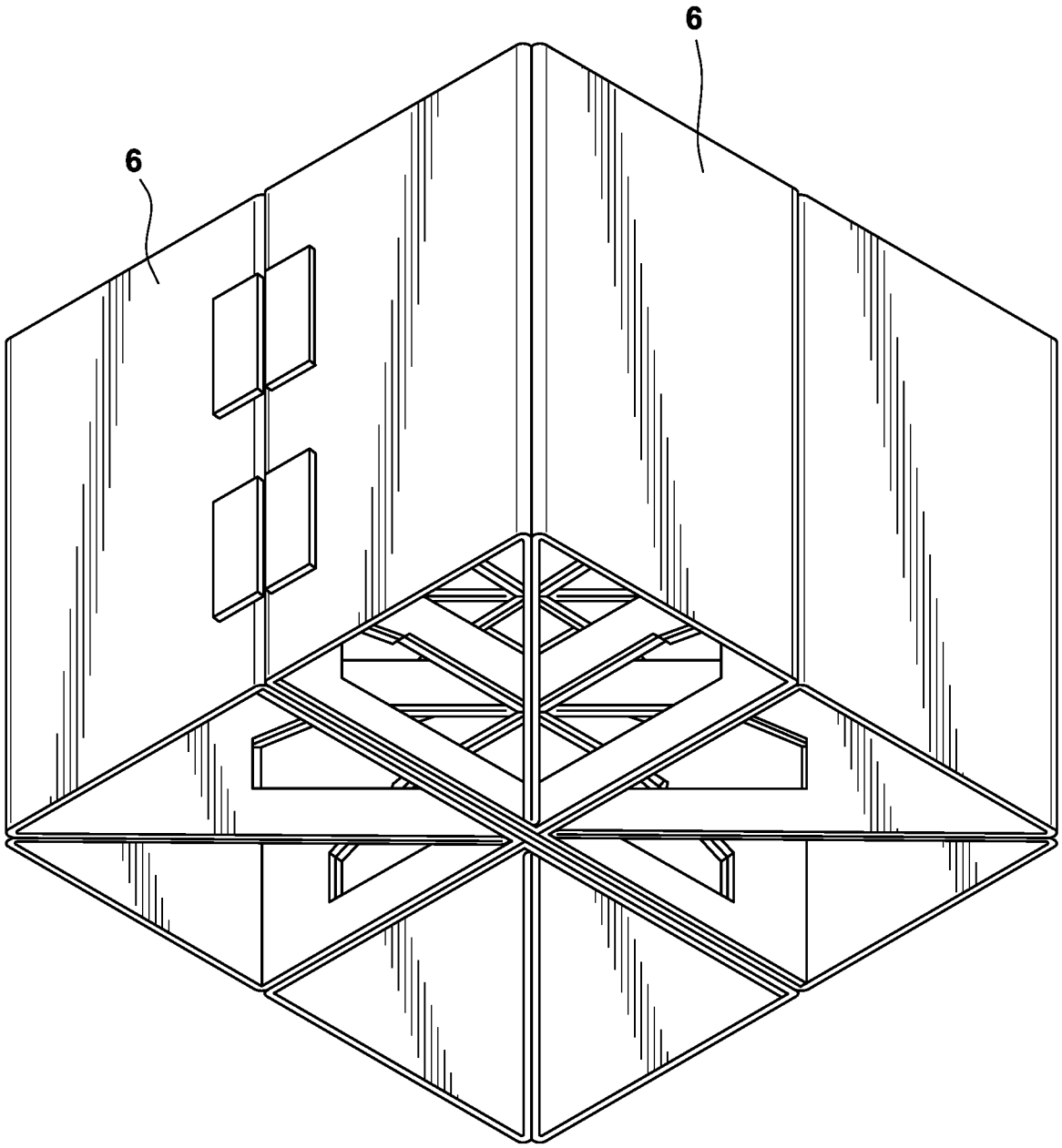
FIG. 2 is a perspective view of an embodiment of the packaging structure with openings in the front and interior walls.
Figure 3:
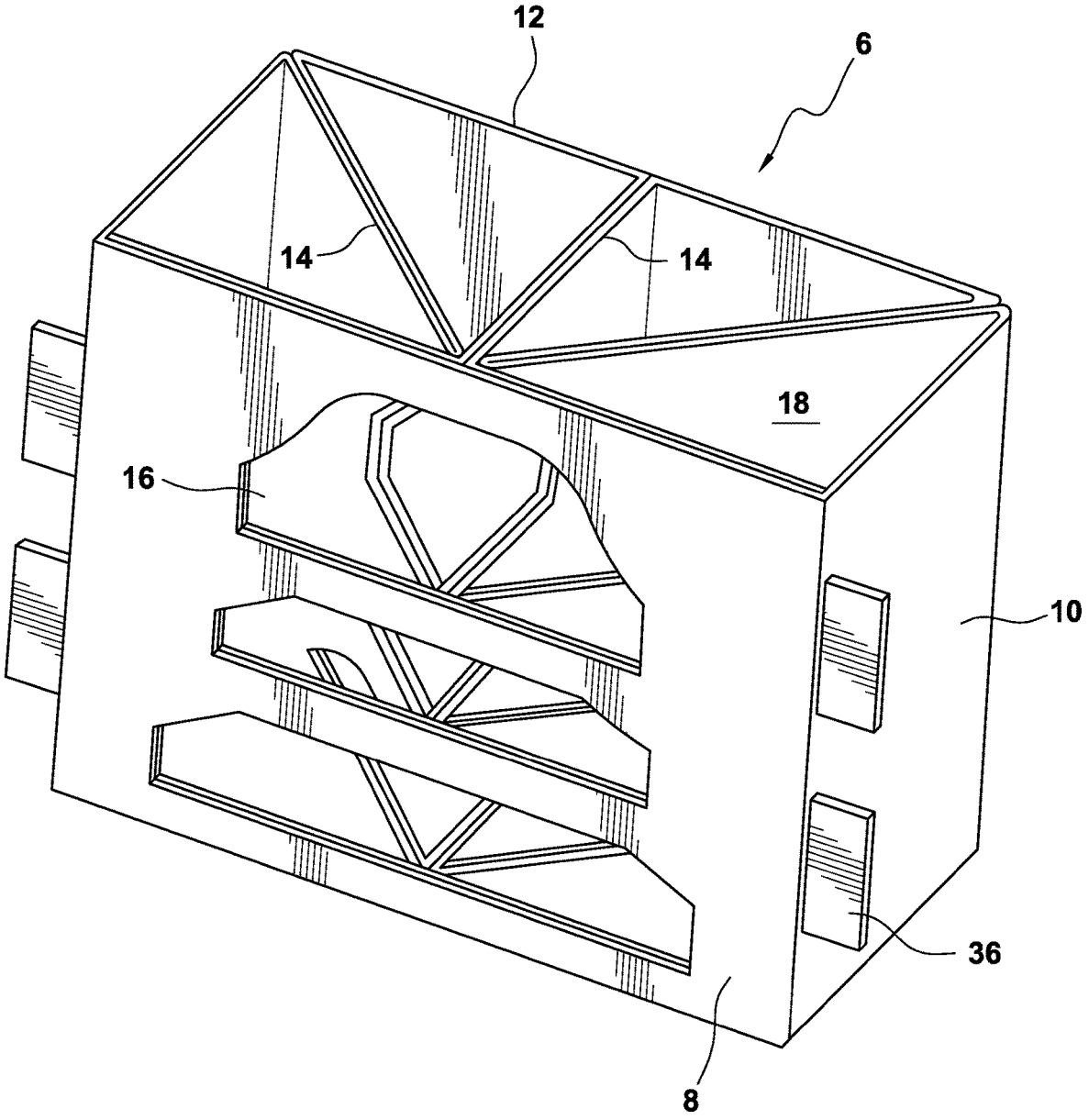
FIG. 3 is perspective view of an embodiment of one support structure of the invention.

The present disclosure relates broadly to packaging structures, and more particularly to packaging structures made from foldable material such as cardboard, fiberboard, or corrugated plastic and used for securing one or more article therein.

Referring to FIGS. 1-5, a first embodiment of a packaging structure 2 with an article 4 placed within the structure will be described.

The packaging structure 2 includes a pair of support structures 6 containing openings 16 in which an article can be placed for storage and shipping. The support structures each include a front wall 8, side walls 10, a back wall 12, and interior walls 14 which form triangular vertical support structures 18. The front and interior walls contain openings 16 which when aligned define compartments in which an article can be placed for safe storage and shipping. The vertically spaced openings can also be used to form a plurality of compartments to store and ship other articles. The packaging structure is configured as a right rectangular prism.

The openings 16 are positioned in vertically spaced relation to prevent the articles in the openings from contacting each other. To protect the articles from outside impact, a minimum safe distance is also provided between the set of openings 16 and the top and bottom of the front 8 and interior 14 walls, and between the openings 16 and the inner surface of the rear 12 and side 10 walls. Preferably, the front 8 and interior 14 walls are double layered and the side 10 and rear 12 walls have at least two layers when placed within a shipping container or box.

Figure 4:
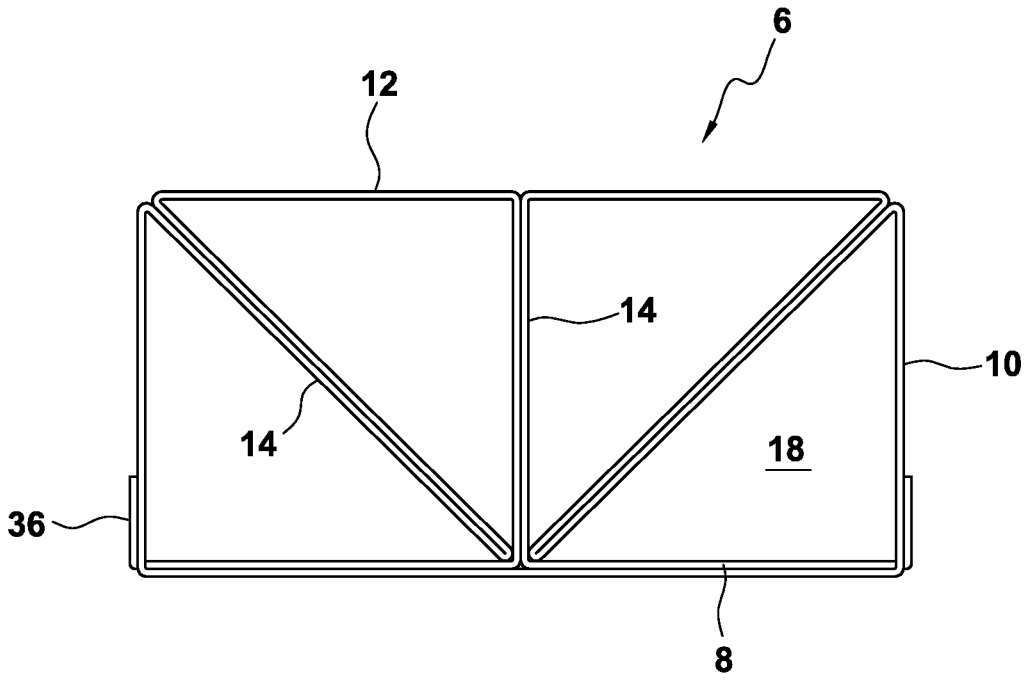
FIGS. 4 and 5 are top and front views, respectively, of one embodiment of the support structures.
Figure 5:
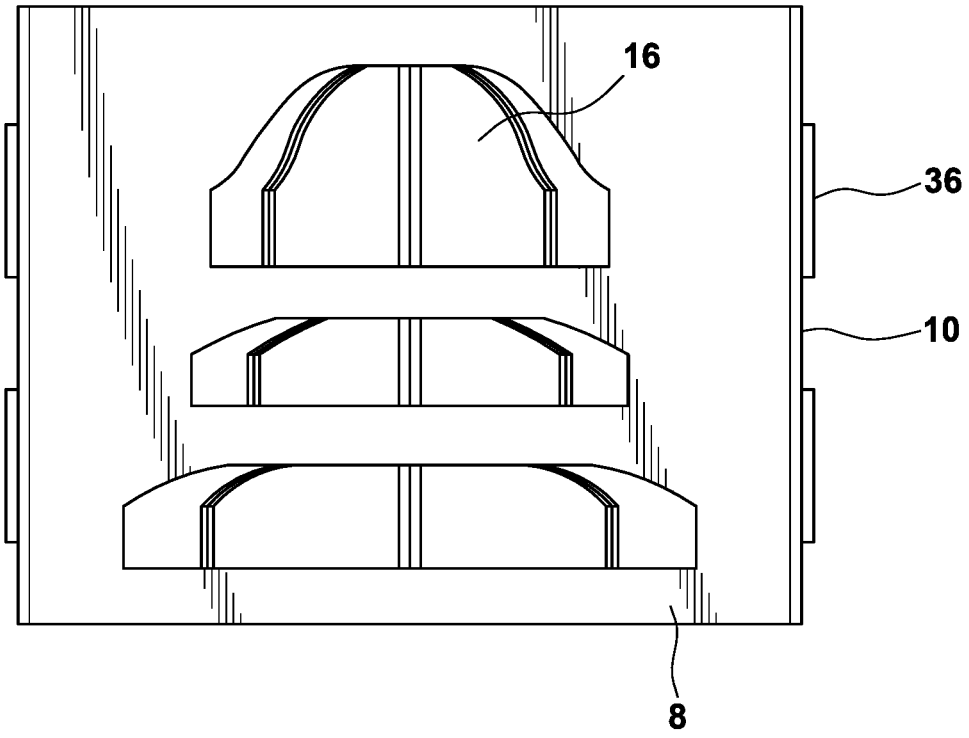
Figure 6:
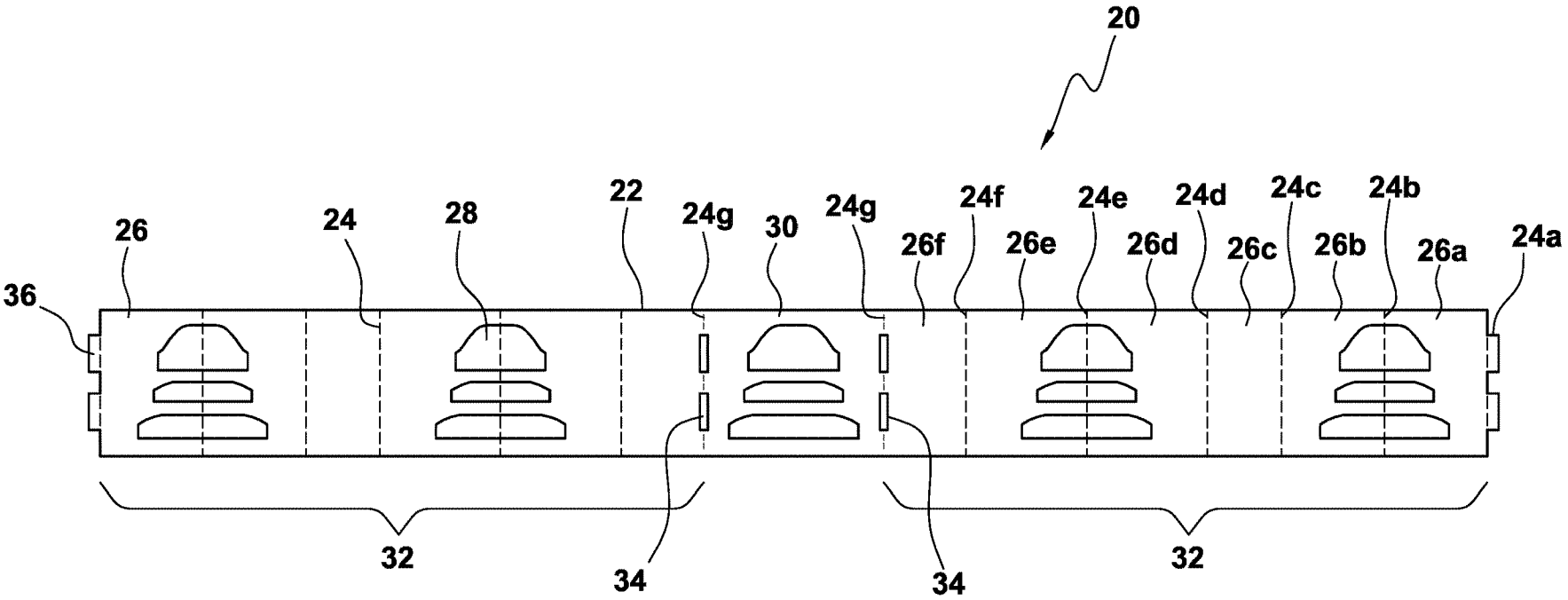
FIG. 6 is a front view of one embodiment of a packaging blank.
Figure 7:
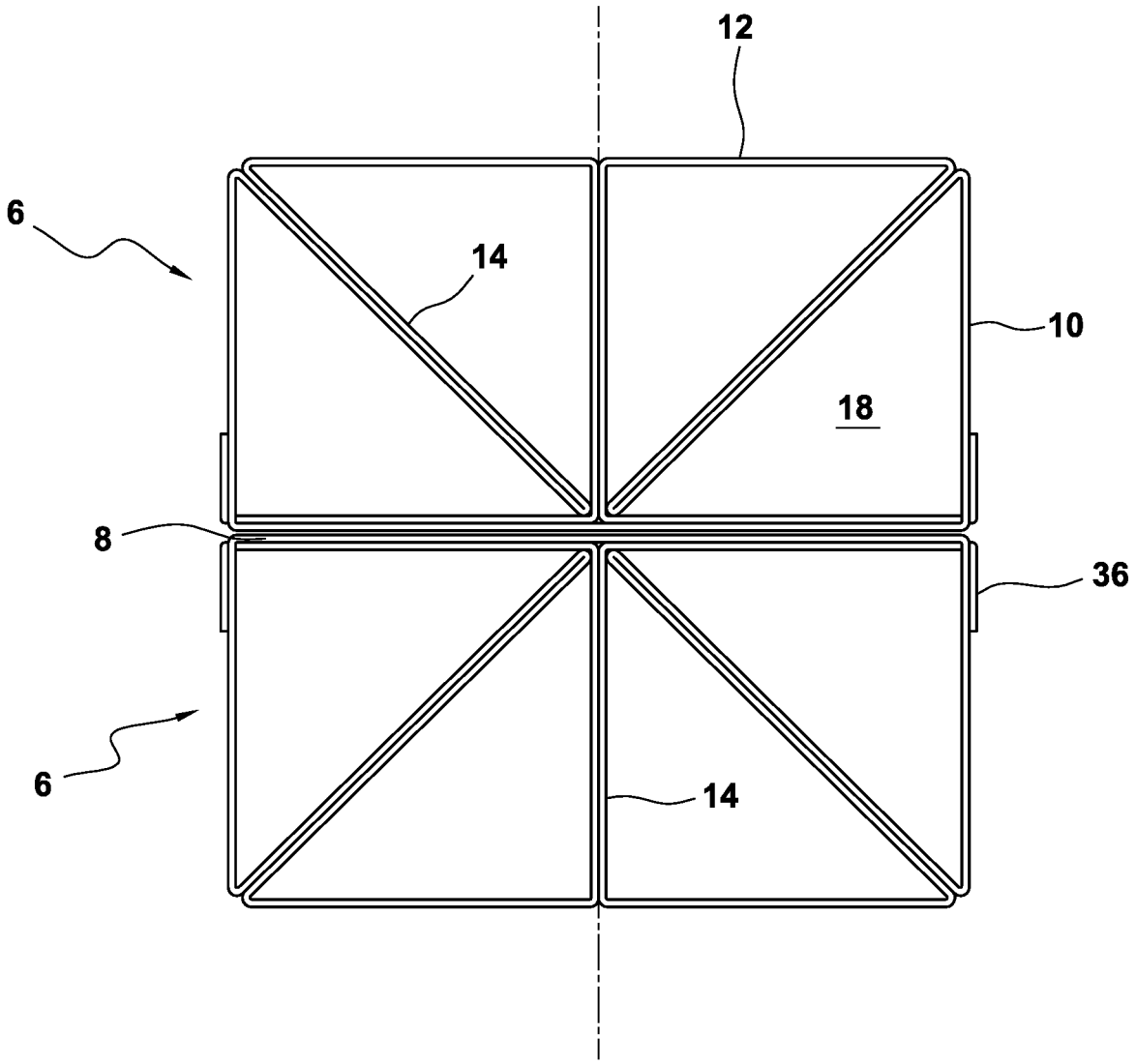
FIG. 7 is a top view of one embodiment of the support structures aligned to form the packaging structure.

Referring now to FIG. 6, a first embodiment of a packaging blank 20 that is used to manufacture packaging structures will be described. The blank is an elongated rectangle 22 made of a foldable material such as cardboard, fiberboard, or corrugated plastic and includes a plurality of spaced vertical fold lines 24, a sequence of rectangular panels 26, and a plurality of aligned openings 28 that correspond with an article to be placed in a packaging structure. Further, the panels are divided into a central panel 30 and two outwardly extending elongated portions 32 including a plurality of spaced fold lines 24*a*, 24*b*, 24*c*, 24*d*, 24*e*, 24*f* and 24*g* defining in sequence first 26*a*, second 26*b*, third 26*c*, fourth 26*d*, fifth 26*e* and sixth 26*f* panels in a direction from said central panel to each end of the blank. As shown in FIG. 4, the first 26*a*, second 26*b* and sixth 26*f* panels are folded about adjacent fold lines to define a first triangular section 18 of the rectangular support structure and the third 26*c*, fourth 26*d* and fifth 26*e* panels are folded about adjacent fold lines to define a second triangular section of the rectangular support structure adjacent to the first triangular section. The first panel 26*a* defines a side wall 10 of the support structure 6 and the second panel 26*d* defines a portion of a rear wall 12 of the support structure. Referring again to FIG. 6, the elongated portions 32 are folded from their outer ends to the central panel 30 and then a series of folds are performed to form a support structure 6 of a packaging structure 2. Projections 36 are pulled through openings 34 in the central panel fold lines 24*a* to interlock the support structure. The following steps demonstrate how to create the support structure:

- Pull the projections 36 through the folding line openings 34 of the central panel 30;
- Fold the projections 36 down fold lines 24*g;*
- Complete a 90° fold at fold line 24*a* to form a side wall 10 of the support structure 6;
- Complete a 135° fold at fold line 24*b* and a 180° fold at fold line 24*c* to form a double layer interior wall 14 of the support structure 6;

Complete a 135° fold at fold line 24*d* to form the back wall 12 of the support structure 6;

Complete a 90° fold at fold line 24*e* to form the middle interior walls 14 of the support structure 6; and Complete a 90° fold at fold line 24*f* to form a double layer to the front wall 8 of the support structure 6.

Following the formation of the blank 20 into the support structure 6, all openings 28 from the blank are aligned to form the openings 16 of the support structure for receiving at least one article.

Figure 8:
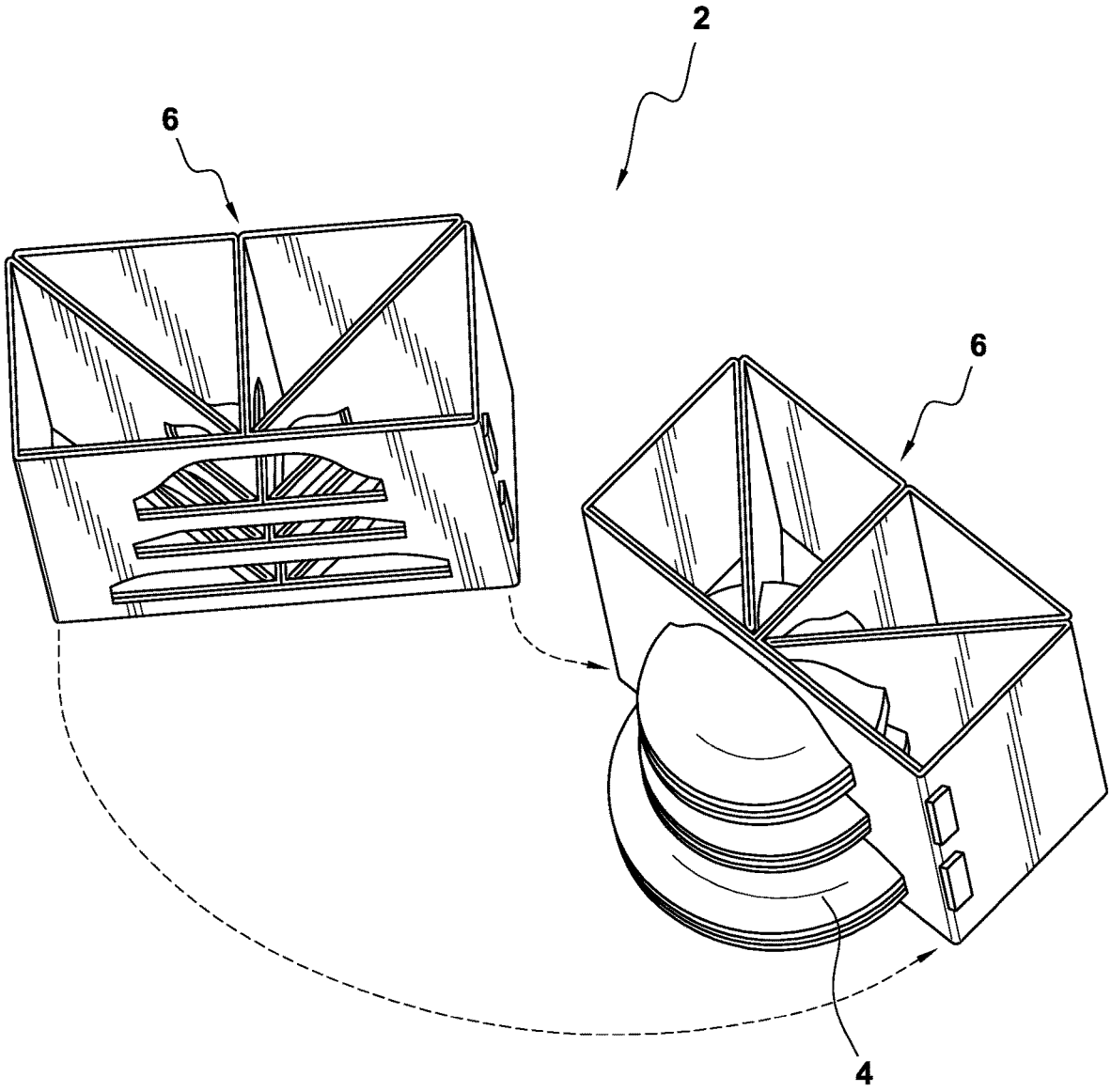
FIG. 8 is a perspective view of one embodiment of the support structures that form the packaging structure with articles placed within the compartments formed by the support structure openings.
Figure 9:
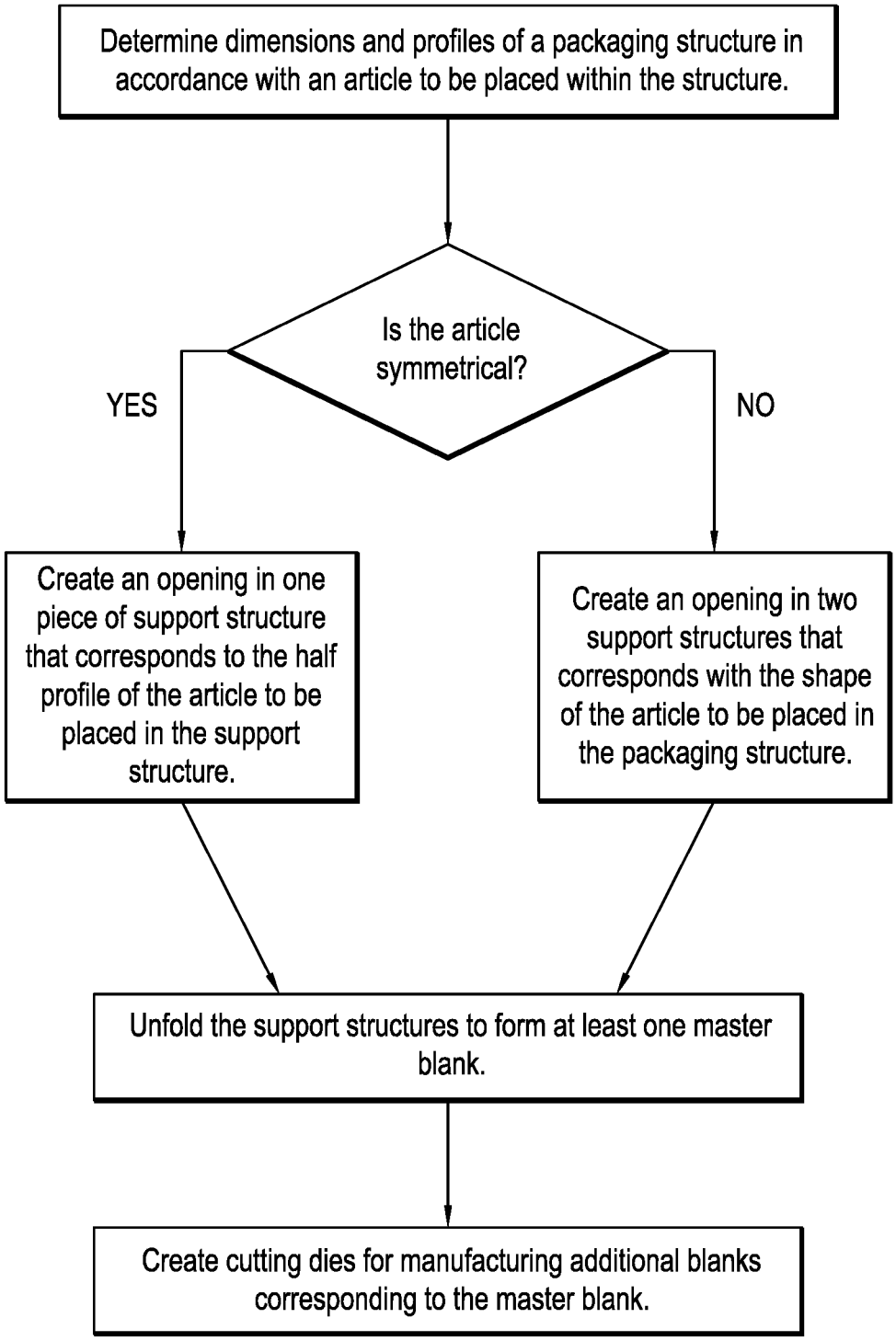
FIG. 9 is a flow chart of a method for forming blanks for forming packaging structures for at least one article.

The steps as detailed above for forming a support structure are repeated with an additional blank to form a second support structure 6. Once two support structures 6 are formed, the article 4 or articles are placed in the compartments formed by aligned openings 16 of one support structure. The second support structure is then placed over the article so that the front walls of each support structure are aligned in contiguous relation, as shown in FIG. 8. This forms a protective packaging structure 2 for the article 4.

Referring now to FIGS. 9-12, a method for creating blanks made from a recyclable material such as corrugated cardboard that is used for forming a packaging structure for at least one article will be described.

To facilitate the creation of cutting dies to be used for the manufacture of subsequent packaging structures a flat pattern is developed by determining the dimensions and profile of a packaging structure in accordance with the dimensions and profile of an article that is to be placed within the structure. First, a support structure is formed in a computer aided design software. If the article to be placed in the packaging structure has rotational symmetry so that the two support structures that make up the packaging structure will be identical, a compartment that corresponds to the shape of half of the article is created within the support structure. If the article to be placed in the packaging structure is asymmetrical, a compartment that corresponds with the shape of a portion of the article is placed within one support structure, and a compartment that corresponds with the remainder of the article is placed within the other support structure. Once the compartment is created to define the shape and location of the openings in the front and interior walls of either one or both support structures, the support structures are unfolded in a computer aided design software to form a flat pattern showing the location of the cut lines required to make the cutting dies for manufacturing additional support structures.

Figure 10:
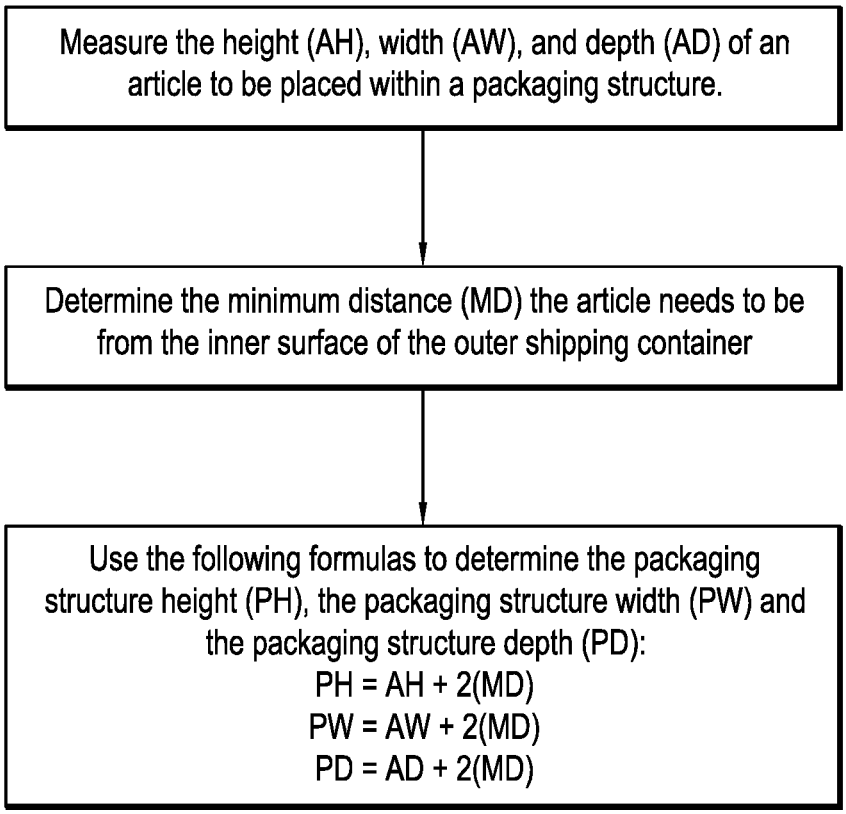
FIG. 10 is a flow chart for determining the size of a packaging structure.

FIG. 10 illustrates a series of measurements and formulas that are taken and used to determine the dimensions and profiles of a packaging structure. First, measure the height (AH), the width (AW), and the depth (AD) of the article that will be placed within a packaging structure. Then determine the minimum distance (MD) the article will need to be from the inner surface of the walls of the outer shipping container or box. Once the measurements have been taken, the following formulas are used to determine the packaging structure height (PH), the packaging structure width (PW), and the packaging structure depth (PD):

$$PH=AH+2(MD)$$

$$PW=AW+2(MD)$$

$$PD=AD+2(MD)$$

Figure 11:
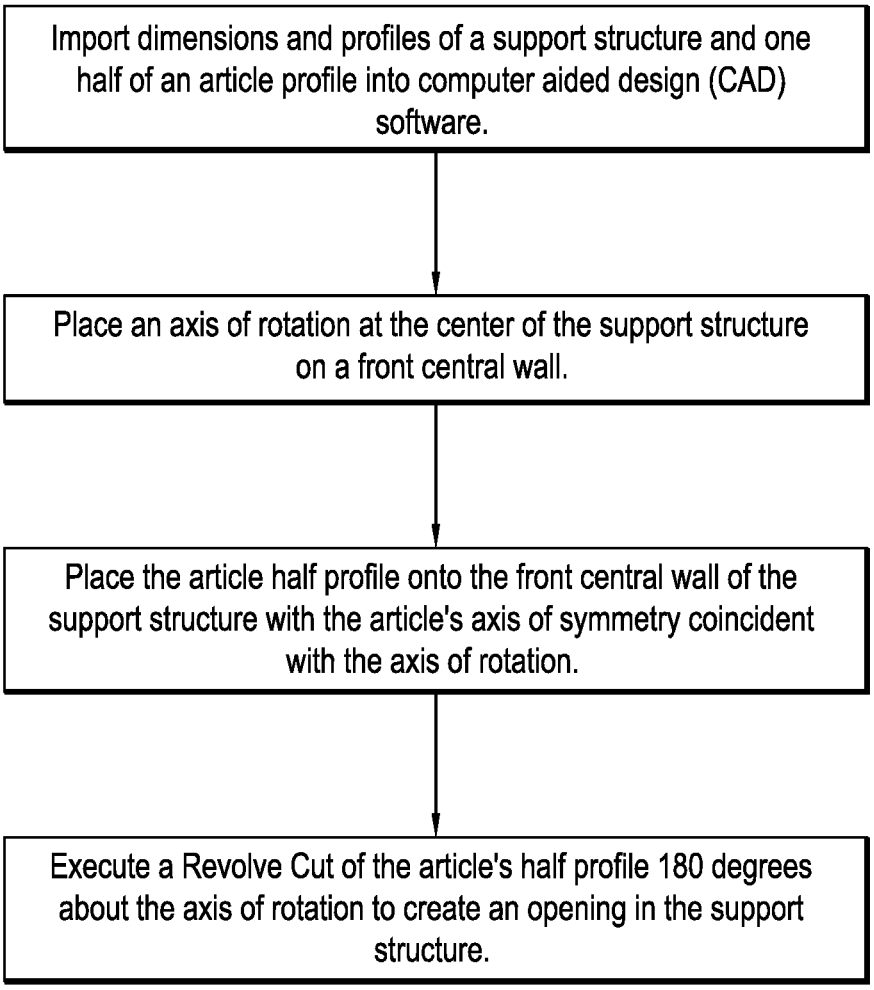
FIGS. 11 and 12 are flow charts for creating openings in a blank that correspond with either a symmetrical or asymmetrical article, respectively.

FIG. 11 illustrates a series of steps that are followed to create a compartment that corresponds to an article with rotational symmetry. First, import the dimensions and profiles of a support structure according to the formulas above, as well as one half of the article's profile as determined by the article's rotational axis of symmetry, into computer aided design (CAD) software. With the tools of the software, place an axis of rotation at the center of the support structure on a front central wall of the support structure. Place the article's half profile onto the front central wall of the support structure with the article's rotational axis of symmetry coincident with the axis of rotation. Have the software program execute a Revolve Cut of the article's half profile 180 degrees about the axis of rotation through the support structure to create the openings in the support structure front and interior walls in the shape of the article's half and defining cut edges of the openings in the walls. The packaging support structure can then be unfolded and used as a master blank as described above.

Figure 12:
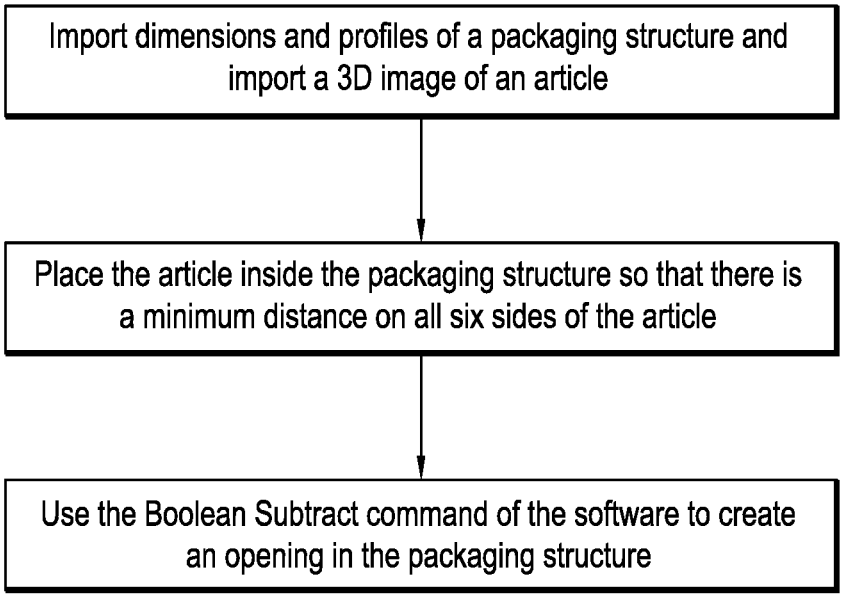

FIG. 12 illustrates the steps that are used to create an opening that corresponds to an asymmetrical article. First, import the dimensions and profiles of a packaging structure according to the formulas above, as well as a three-dimensional image of the article to be placed within the packaging structure, into computer aided design (CAD) software. With the tools of the software, place the article inside the packaging structure so that there is a minimum distance maintained on all six sides for the article. Then use a Boolean Subtract command of the software to create an opening in the packaging structure which defines the shape and location of the cut edges of the openings in front walls and interior walls of the packaging structure. Lastly, unfold the packaging structure to be used as master blank as detailed above.

The method for creating packaging blanks, including the openings for the articles, makes it possible to quickly and easily define and implement the location of the cuts on the master blank to form the openings. Locating the cuts on an unfolded master blank using only geometrical calculations would be challenging and nearly impossible because the vertices of the interior walls do not meet the axis of rotation on the front face and the walls have a thickness which displaces and distorts the cut lines of the profile of the article as the profile is revolved through the structure.

While the preferred forms and embodiments of the invention have been illustrated and described, it will be apparent to those of ordinary skill in the art that various changes and modifications may be made without deviating from the inventive concepts set forth above.

What is claimed is:

1. A method for forming a blank for forming a packaging structure from foldable material for at least one article, the method comprising the steps of:

a. determining dimensions and a profile of the packaging structure in accordance with dimensions and a profile of the at least one article and a desired distance between the at least one article and an inner surface of an outer shipping container or box;

b. forming openings in said packaging structure that correspond in configuration with a shape of the at least one article;

c. unfolding said packaging structure to form at least one master blank of foldable material as an industry standard flat pattern; and d. creating cutting dies for manufacturing additional blanks corresponding to said at least one master blank.

2. A method as defined in claim 1, wherein said determining step comprises:

e. measuring a height, a width, and a depth of the at least one article;

f. determining a minimum distance of the at least one article from walls of the shipping container or box so that the at least one article is protected during shipping; and g. determining a height, a width, and a depth of the packaging structure according to the following formulas:

$$PH=AH+2(MD)$$

$$PW=AW+2(MD)$$

$$PD=AD+2(MD)$$

where PH is the height of the packaging structure, AH is the height of the at least one article, MD is the minimum distance, PW is the width of the packaging structure, AW is the width of the at least one article, PD is the depth of the packaging structure, and AD is the depth of the at least one article.

3. A method as defined in claim 1, wherein the at least one article has rotational symmetry, the packaging structure includes a pair of support structures, and said step of forming openings comprises the following steps:

h. importing dimensions and a profile of one of the support structures and one half of the at least one article's profile as determined by said at least one article's rotational axis of symmetry into computer aided design software;

i. placing an axis of rotation at a center of said one of the support structures on a front central wall of said one of the support structures;

j. placing said one half of the at least one article's profile onto said front central wall of said one of the support structures with said at least one article's rotational axis of symmetry coincident with said axis of rotation; and k. having said computer aided design software execute a revolve cut of said one half of the at least one article's profile 180 degrees about the axis of rotation through the one of the support structures to create a compartment in said one of the support structures in a shape of half of the at least one article to define a shape and a location of cut edges of the openings in front and interior walls of the one of the support structures.

4. A method as defined in claim 1, wherein the at least one article is asymmetrical and said step of forming openings comprises:

l. importing said dimensions and said profile of the packaging structure and a three-dimensional image of the at least one article into computer aided design software;

m. placing the at least one article inside the packaging structure within a graphical user interface so that a minimum distance is maintained on all six sides for the at least one article; and n. using a Boolean Subtract command of said software to create a compartment in said packaging structure in the shape of the at least one article to define a shape and a location of cut edges of the openings in interior walls of the packaging structure.

* * * * *